US007051560B2

(12) United States Patent
Sanchirico, Jr. et al.

(10) Patent No.: US 7,051,560 B2
(45) Date of Patent: May 30, 2006

(54) ELECTROMAGNETIC DOOR SECURITY SYSTEM

(75) Inventors: John A. Sanchirico, Jr., Bristol, CT (US); John L. Schum, Thomaston, CT (US)

(73) Assignee: DynaLock Corporation, Bristol, CT (US)

( * ) Notice: Subject to any disclaimer, the term of this patent is extended or adjusted under 35 U.S.C. 154(b) by 0 days.

(21) Appl. No.: 11/101,256

(22) Filed: Apr. 6, 2005

(65) Prior Publication Data

US 2005/0237214 A1 Oct. 27, 2005

Related U.S. Application Data

(60) Provisional application No. 60/560,345, filed on Apr. 7, 2004.

(51) Int. Cl.
*E05B 65/10* (2006.01)

(52) U.S. Cl. ..... 70/92; 292/92; 70/276

(58) Field of Classification Search ..... 292/92, 292/93, 336.3, 168, 251.5, DIG. 65; 70/92, 70/276, 277, DIG. 51; 340/542, 543, 545; 361/161, 171, 152, 139
See application file for complete search history.

(56) References Cited

U.S. PATENT DOCUMENTS

| | | | | |
|---|---|---|---|---|
| 4,871,204 | A * | 10/1989 | Cook et al. | 292/251.5 |
| 5,479,151 | A * | 12/1995 | Lavelle et al. | 340/542 |
| 5,517,176 | A * | 5/1996 | Lavelle et al. | 340/542 |
| 5,988,708 | A * | 11/1999 | Frolov et al. | 292/92 |
| 6,104,594 | A * | 8/2000 | Frolov et al. | 361/152 |
| 2004/0255626 | A1 * | 12/2004 | Petasch et al. | 70/241 |
| 2005/0044908 | A1 * | 3/2005 | Min | 70/276 |

* cited by examiner

*Primary Examiner*—Brian E. Glessner
*Assistant Examiner*—William Schrode
(74) *Attorney, Agent, or Firm*—Michaud-Duffy Group LLP

(57) ABSTRACT

An exit sensor bar for securing a door has an elongated housing and a mounting pad for mounting to a door. A circuit board assembly is disposed within the elongated housing in proximity to a blade of the mounting pad. The circuit board assembly includes at least an electro-optical source and an electro-optical detector coupled to a lock. The electro-optical detector selectively energizing and de-energizing the lock in response to the detection of light emitted from the electro-optical source. When a push force is applied to the elongated housing, the housing is displaced toward the mounting pad such that the blade obstructs light emitted from the electro-optical source. In response to the non-detection of the emitted light, the electro-optical detector de-energizes the lock freeing the door for egress.

9 Claims, 4 Drawing Sheets

ELECTROMAGNETIC DOOR SECURITY SYSTEM

CROSS-REFERENCE TO RELATED APPLICATIONS

This patent application claims the benefit under 35 U.S.C. §119(e) of U.S. Provisional Patent Application Ser. No. 60/560,345, filed Apr. 7, 2004, the disclosure of which is incorporated by reference herein in its entirety.

FIELD OF THE INVENTION

The present invention is directed to door security systems and, more particularly, to the use of a push or exit bar for securing a door equipped with an electromagnetic lock.

BACKGROUND OF THE INVENTION

Push bars or exit bars which allow egress through a doorway while limiting ingress are well-known components of door security and emergency systems. Conventional exit bars are mounted on an interior side of a door to be secured and are oriented generally horizontally across the face of the door. A push force exerted on the push or exit bar in the direction of the interior side of the door operates a door latch to permit opening of the door. Conventional exit bars typically employ a mechanical linkage to actuate the door latch mechanism for unlatching the door. Exit bars may also employ mechanical locks to secure the door from opening. A handle can also be provided on an exterior face of the door to actuate the door latch mechanism and allow ingress under certain circumstances. Exit bars have also been connected to alarm systems and/or monitoring devices to warn security personnel of a door opening.

Conventional exit bar systems exhibit a number of deficiencies. For example, mechanical components typically require a substantial amount of adjustment at initial installation and periodic maintenance to ensure proper functioning. Additionally, during periods of high traffic levels through a doorway, mechanical latch mechanisms of a conventional exit bar can experience a high rate of wear.

Thus, there is a need for an improved door security system and, in particular, a door security system employing a non-mechanical latching mechanism.

SUMMARY OF THE INVENTION

One preferred embodiment of the present invention provides an exit sensor bar for mounting to a door. The door is operable between a locked and unlocked condition by selective energizing and de-energizing an electromagnetic lock affixed to the door and a door frame. The exit sensor bar includes a mounting pad for affixing the exit sensor bar to the door. The mounting pad includes a blade extending away from the mounting pad. The sensor bar also includes an elongated housing having an interior chamber. The interior chamber has a first portion for receiving the mounting pad and a second portion. At least one return spring is disposed on the mounting pad and within the interior chamber for biasing the elongated housing in a direction away from the mounting pad.

The sensor bar further includes a circuit board assembly disposed within the second portion of the interior chamber in close proximity to the mounting pad. The circuit board assembly includes at least an electro-optical source and an electro-optical detector coupled to the electromagnetic lock.

The electro-optical detector is disposed a distance away from the electro-optical source to define a transmission path for light emitted from the electro-optical source. The electro-optical detector selectively energizes and de-energizes the electromagnetic lock in response to the detection of the emitted light. In operation, when a push force is applied to the elongated housing, the elongated housing is displaced toward the mounting pad such that the blade of the mounting pad traverses the transmission path obstructing light emitted from the electro-optical source so that the emitted light is not detected by the electro-optical detector. In response to the non-detection of the emitted light, the electro-optical detector de-energizes the electromagnetic lock permitting egress through the door.

The exit sensor bar also preferably includes a relay operatively coupling the electro-optical detector and the electromagnetic lock. The relay is selectively energized and de-energized by the electro-optical detector for energizing and de-energizing the electromagnetic lock.

In certain embodiments, a security system for a door is provided. The door is mounted to a door frame that is installed in a building structure. The security system includes a lock mounted to the door. The lock is selectively operable between a first condition, in which the door is retained in a fixed position to the door frame, and a second condition, in which the door is released for displacement away from the door frame. The security system also includes a relay coupled to the lock. The relay is selectively energized to provide a first signal to the lock for operation in the first condition and de-energized to provide a second signal to the lock for operation in the second condition.

The security system also includes a sensor bar mounted to the door and operatively coupled to the relay. The sensor bar includes a pair of mounting pads for affixing the sensor bar to the door, where at least one of the pair of mounting pads including a blade extending away from the at least one mounting pad. The sensor bar includes an elongated housing having an interior chamber. The interior chamber has a first portion for receiving the mounting pads and a second portion. A pair of return springs are disposed on the mounting pads and within the interior chamber for biasing the elongated housing in a direction away from the mounting pads. The sensor bar also includes a circuit board assembly disposed within the second portion of the interior chamber in close proximity to the at least one mounting pad. The circuit board assembly includes at least an electro-optical source and an electro-optical detector coupled to the relay. The electro-optical detector is disposed a distance away from the electro-optical source to define a transmission path for light emitted from the electro-optical source. The electro-optical detector selectively energizes and de-energizes the relay to provide at least one of the first and second signals in response to the detection of the emitted light. In operation, when a push force is applied to the elongated housing, the bias of the return spring is overcome and the elongated housing is displaced toward the mounting pads such that the blade of the at least one mounting pad traverses the transmission path obstructing light emitted from the electro-optical source so that the emitted light is not detected by the electro-optical detector. In response to the non-detection of the emitted light, the electro-optical detector de-energizes the relay.

BRIEF DESCRIPTION OF THE DRAWINGS

The features and advantages of the present invention are better understood when the Detailed Description of the Preferred Embodiments given below is considered in conjunction with the following figures.

In these figures, like structures are assigned like reference numerals, but may not be referenced in the description of all figures.

DETAILED DESCRIPTION OF PREFERRED EMBODIMENTS

Figure 1:
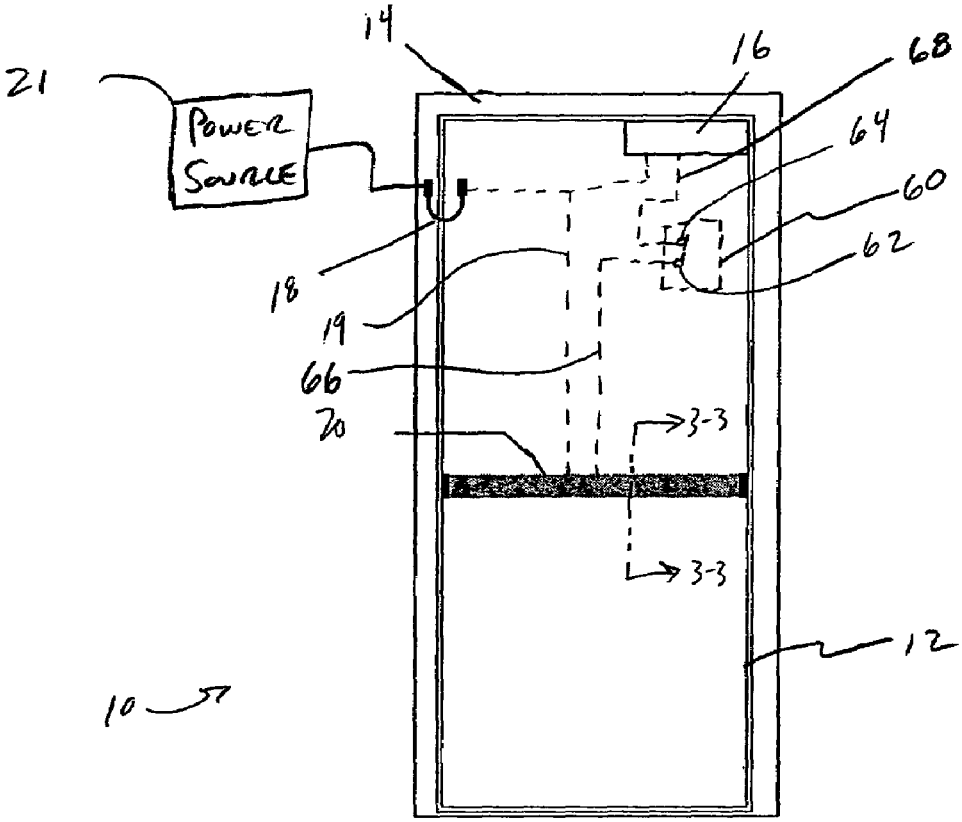
FIG. 1 is a schematic view of a door security system configured and operating in accordance with one embodiment of the present invention.

FIG. 1 illustrates a door security system 10 configured and operating in accordance with one embodiment of the present invention wherein the door security system 10 includes an exit sensor bar 20 such as, for example, a non-latching model 6450 Exit Sensor Bar of DynaLock Corporation (Bristol, Conn. USA), assignee of the present invention, mounted in a horizontal position across an interior side of a door 12. The door 12 is mounted to a door frame 14 of a building structure (not shown) through which egress is to be monitored and/or controlled. An electromagnetic lock 16 such as, for example, a 3000 Series electromagnetic lock of DynaLock Corporation, is mounted to a portion of the door 12 and the door frame 14 for selectively controlling egress through the door 12.

As shown in FIG. 1, a cable 18 extends from the door frame 14 to the door 12 to provide power (over line 19) from an external power source 21 (e.g., a 12 to 24V AC-DC power supply such as a 5025 series solid state power supply of DynaLock Corporation) for operating the electromagnetic lock 16 and the exit sensor bar 20 of the door security system 10. The door security system 10 includes a control relay 60 operatively coupling the exit sensor bar 20 and the electromagnetic lock 16. The control relay 60 includes contacts 62 and 64 that are held closed when the control relay 60 is energized and open when the control relay 60 is de-energized. When the contacts 62 and 64 are closed, a circuit (represented by lines 66 and 68) is complete and the electromagnetic lock 16 is energized. As is generally known in the art, when energized the electromagnetic lock 16 generates a magnetic field of sufficient holding force (e.g., about fifteen hundred pounds) to retain the door 12 to the door frame 14. As described in detail below, when depressed the exit sensor bar 20 de-energizes the control relay 60 (e.g., opens contacts 62 and 64), which in turn de-energizes the electromagnetic lock 16, terminating the magnetic field and releasing the door 12 from the door frame 14 so that it may be opened.

In one embodiment, the control relay 60 is coupled to a key switch or card reader such as, for example, a 7200 series digital entry keypad of DynaLock Corporation (not shown), located on the exterior side of the door 12 and operated independent of the exit sensor bar 20 to de-energize the electromagnetic lock 16 and open the door 12. In one embodiment, the door security system 10 is coupled to other security and/or monitoring systems through the cable 18. For example, the cable 18 provides a communication link from the door security system 10 to the other security and/or monitoring systems for monitoring operation of the door security system 10 as needed.

Figure 3:
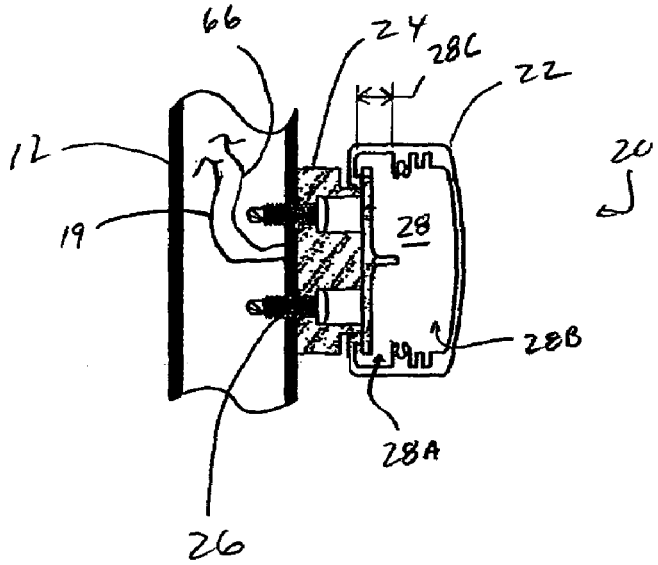
FIG. 3 shows a cross-sectional view of the exit sensor bar of FIG. 2 taken along lines 3—3 of FIG. 1.
Figure 2:
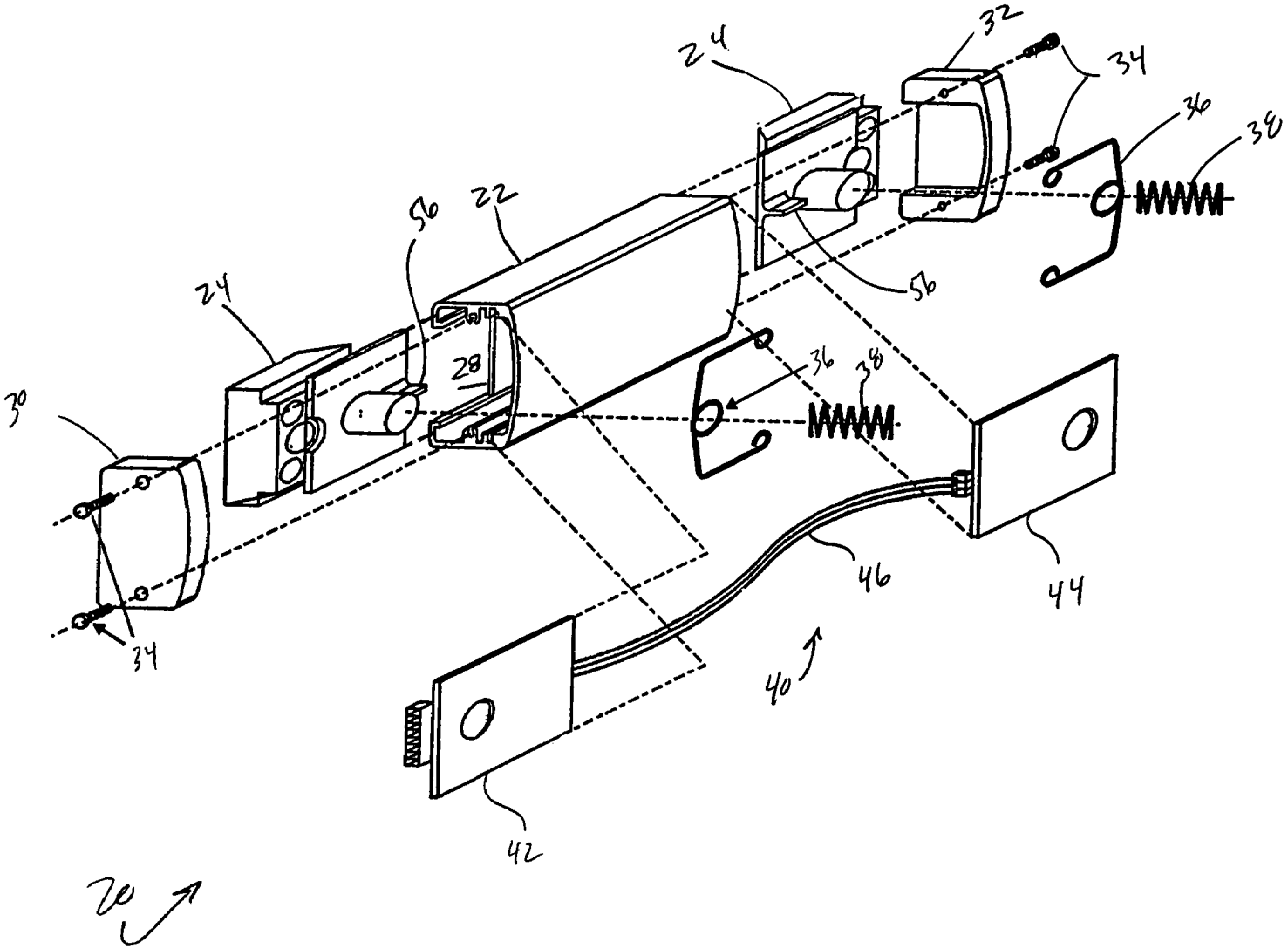
FIG. 2 is an exploded view of an exit sensor bar assembly configured and operating in accordance with one embodiment of the present invention.

FIG. 2 is an exploded assembly view of the exit sensor bar 20 in accordance with one embodiment of the present invention. FIG. 3 is a partial cross-sectional view of the exit sensor bar 20 mounted to the door 12. As shown in FIGS. 2 and 3, the exit sensor bar 20 includes an elongated housing 22 that receives and is mounted to a pair of mounting pads 24 having openings which receive fasteners 26 for securing the exit sensor bar 20 to the door 12. The elongated housing 22 defines an interior channel 28 having a first 28A and a second portion 28B. As described below, the elongated housing 22 is traversely displaceable along a height 28C of the first portion 28A of the interior channel in directions toward and away from the mounting pads 24. The second portion 28B of the interior channel 28 receives components of the exit sensor bar 20. It should be appreciated that the elongated housing 22 may be comprised of one of a plurality of lengths sufficient to substantially span a plurality of doors each having a different width.

The interior channel 28 is terminated at opposing ends of the elongated housing 22 by end caps 30 and 32, respectively. In one embodiment, the end caps 30 and 32 are secured to the elongated housing 22 by fasteners 34. In another embodiment, the end caps 30 and 32 may be affixed to the housing 22 by frictional engagement. In one embodiment, the internal channel 28 is terminated by a back plate (not shown) disposed between the pair of mounting pads 24. Preferably, the end caps 30 and 32, mounting pads 24 and back plate substantially prevent contaminants from entering the internal channel 28 and/or prevent unauthorized access to components of the exit senor bar 20 disposed within the channel 28. In one embodiment, the elongated housing 22, the mounting pads 24 and the end caps 30 and 32 are constructed of metal components to provide a relatively high resistance to abuse, damage, fire and/or vandalism.

Figure 4A:
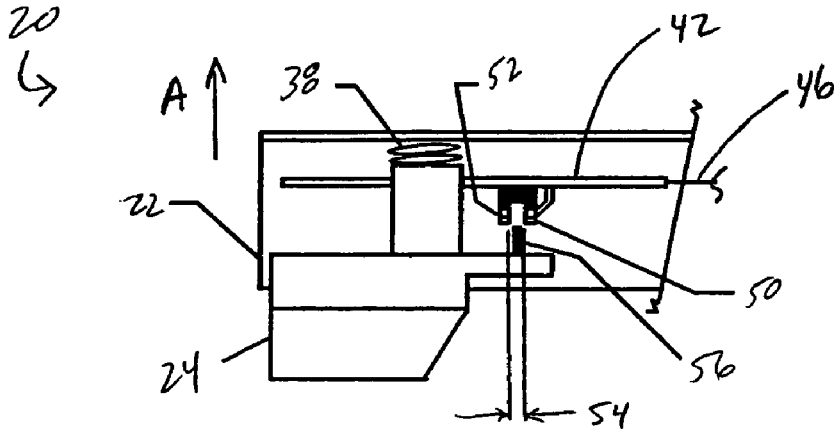
FIGS. 4A and 4B show a side, partially cross-sectional view of the exit sensor bar assembly illustrating actuation of the exit sensor bar assembly in response to an applied push force.
Figure 4B:
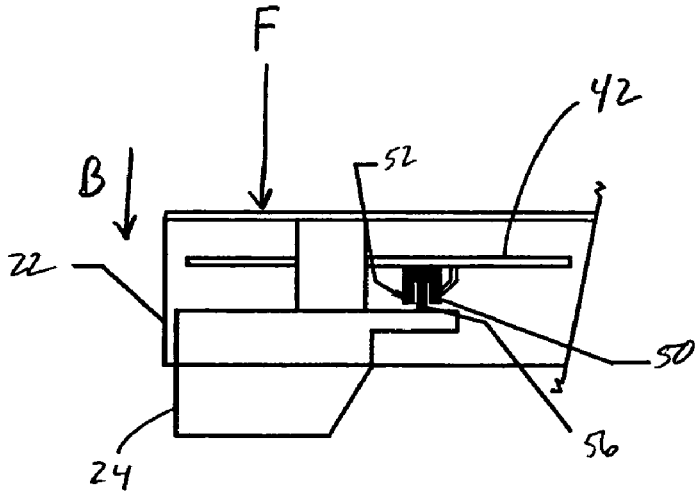

The exit sensor bar 20 includes a pair of anti-rattle springs 36 and a pair of return springs 38. As shown in FIG. 4A, each of the return springs 38 biases the elongated housing 22 within the first portion 28A of the internal channel 28 in a direction (illustrated by arrow A) away from the mounting pads 24 and the door 12 such that the elongated housing 22 is disposed at substantially the full height 28C of the first portion 28A. Referring again to FIG. 2, the exit sensor bar 20 also includes a circuit board assembly 40 disposed within a second portion 28B of the interior channel 28. In one embodiment, the circuit board assembly 40 includes a hinge end circuit board 42, a latch end circuit board 44 and a wiring harness 46 coupling the hinge end circuit board 42 and the latch end circuit board 44. As shown in FIGS. 4A and 4B, the hinge end circuit board 42 includes an electro-optical source 50 and an electro-optical detector 52 disposed a distance away from the electro-optical source 50. The distance away defines a transmission path 54 of light (e.g., infra-red light) emitted from the electro-optical source 50 and received by the electro-optical detector 52. In accordance with the present invention, when the transmission path 54 is unobstructed (FIG. 4A) the electro-optical detector 52 detects the light emitted from the electro-optical source 50.

In one embodiment, the circuit board assembly 40 in enclosed in a sealed housing or compartment, as is generally known in the art, disposed within the second portion 28B of the interior channel 28.

It should be appreciated that the latch end circuit board 44 is configured in a substantially similar manner as the hinge end circuit board 42 illustrated in FIGS. 4A and 4B. The inventors have realized that this dual sensor configuration provides improved reliability while minimizes maintenance costs typically associated with conventional mechanical latch systems. It should also be appreciated, however, that it is within the scope of the present invention to employ only one of the hinge end and latch end circuit boards 42 and 44 within an embodiment of the inventive door security system 10.

The mounting pad 24 includes a blade 56 disposed in close proximity to and extending from the mounting pad 24 toward the transmission path 54. When a push force F is applied to the elongated housing 22 in a direction (illustrated by arrow B) toward the mounting pad 24 by a person seeking egress through the door 12, the bias of the return springs 38 is overcome, the elongated housing 22 is displaced toward the mounting pad 24 (in the direction illustrated by arrow B). As the elongated housing 22 approaches the mounting pad 24, the blade 56 traverses the transmission path 54. As shown in FIG. 4B, when the blade 56 traverses the transmission path 54, the electro-optical detector 52 no longer detects the light emitted from the electro-optical source 50.

Figure 5A:
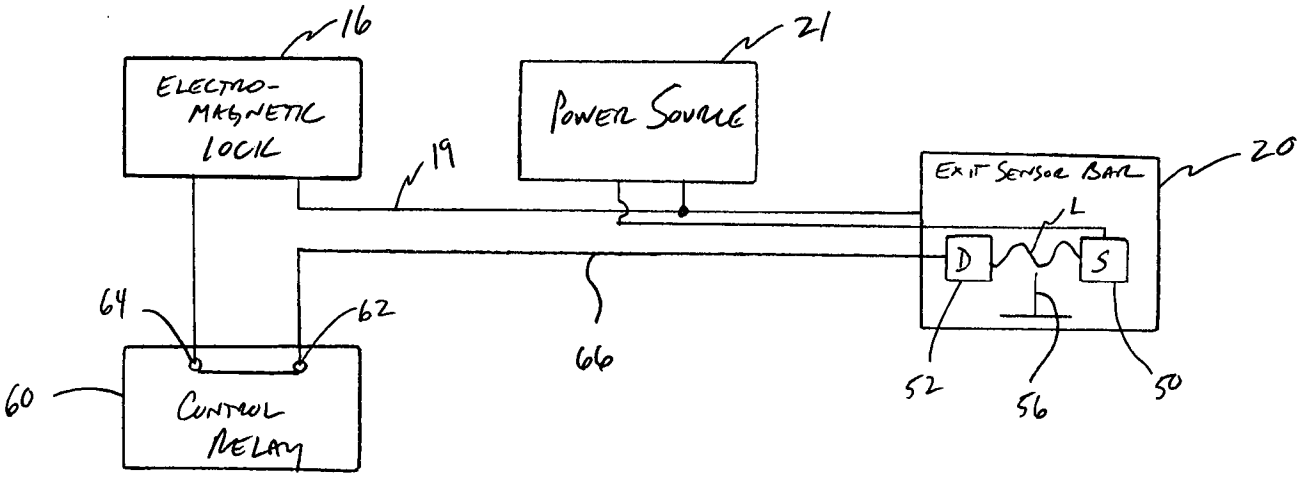
FIGS. 5A and 5B depict simplified block diagrams of the door security system of FIG. 1 illustrating an electrical circuit connection of the door system at rest and at actuation.
Figure 5B:
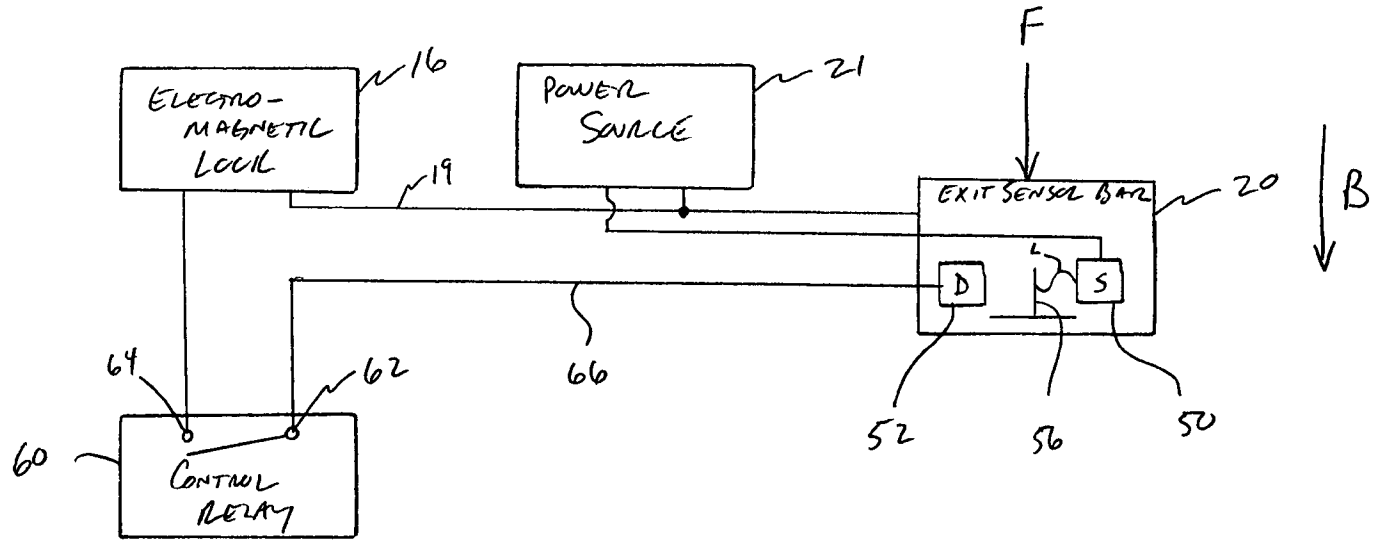

FIGS. 5A and 5B depict simplified block diagrams of the door security system 10 illustrating the electrical circuit of the door system 10 at rest, e.g., when no push force F is applied to the exit sensor bar 20 (FIG. 5A), and at actuation, e.g., when the push force F is applied to the exit sensor bar 20 (FIG. 5B). As shown in FIGS. 4A and 5A, when no push force F is applied, light L emitted from the electro-optical source 50 is detected by the electro-optical detector 52, e.g., the transmission path 54 is unobstructed. The electro-optical detector 52 energizes the control relay 60 (over line 66) for the entire period of time that the light L is detected. As described above, the contacts 62 and 64 of the control relay 60 remain closed as the control relay 60 remains energized. Since the contacts 62 and 64 are held closed, the control relay 60 energizes the electromagnetic lock 16 (over line 68). The electromagnetic lock 16 therefore, generates the magnetic field to hold the door 12 closed against the door frame 14.

As shown in FIGS. 4B and 5B, when the push force F is applied, light L emitted from the electro-optical source 50 is not detected by the electro-optical detector 52 since the transmission path 54 is obstructed by the blade 56. While the electro-optical detector 52 does not detect the emitted light L, the detector 52 de-energizes the control relay 60 (over line 66). When the control relay 60 is de-energized, the contacts 62 and 64 of the control relay 60 remain open. Since the contacts 62 and 64 are open, the control relay 60 de-energizes the electromagnetic lock 16 (over line 68). The electromagnetic lock 16 therefore, terminates the magnetic field to release the door 12 previously held against the door frame 14.

In one embodiment, the elongated housing 22 may be displaced by applying a push force F of, for example, about fifteen pounds or less of pressure at any point along the length of the elongated housing 22. This relatively "light touch" (e.g., minimum amount of applied push force) is preferred so that the exit sensor bar 20 may be actuated by human touch, a briefcase, a cane, hip, wheelchair, elbow, and the like, to make the door security system 10 of the present invention particularly well suited for installation in facilities conforming to the American with Disabilities Act (ADA) such as hospitals, health care facilities and the like.

It should be appreciated that the use of electro-optical sensing electronics, as described herein, eliminates perceived disadvantages associated with the use of mechanical latching movements. For example, the wear typically associated with mechanical parts is eliminated. Additionally, elimination of mechanical parts is seen to minimize calibration and alignment problems seen during initial installation and period maintenance procedures thus making the inventive door security system more efficient and less costly to maintain than conventional mechanical latched systems. It should also be appreciated that it is within the scope of the present invention to employ other source-detector arrangements, e.g. a radio-frequency transmitter and receiver, magnetic field source and detector, or the like non-mechanical means, to sense an applied push force and trigger the release of a door.

Although the invention herein has been described with reference to particular embodiments, it is to be understood that these embodiments are merely illustrative of the principles and applications of the present invention. It is contemplated that the elongated housing 22 may be of a plurality of differing length to accommodate a plurality of standard or custom door widths. It is therefore to be understood that numerous modifications may be made to the illustrative embodiments and that other arrangements may be devised without departing from the spirit and scope of the present invention as defined by the appended claims.

What is claimed is:

1. An exit sensor bar for mounting to a door, the door operable between a locked and unlocked condition by selectively energizing and de-energizing an electromagnetic lock affixed thereto, the exit sensor bar comprising:

a mounting pad for affixing the exit sensor bar to the door, the mounting pad including a blade extending away from the mounting pad;

an elongated housing having an interior chamber, the interior chamber having a first portion for receiving the mounting pad and a second portion;

at least one return spring disposed on the mounting pad and within the interior chamber for biasing the elongated housing in a direction away from the mounting pad; and a circuit board assembly disposed within the second portion of the interior chamber in close proximity to the mounting pad, the circuit board assembly including at least an electro-optical source and an electro-optical detector coupled to the electromagnetic lock, the electro-optical detector being disposed a distance away from the electro-optical source to define a transmission path for light emitted from the electro-optical source, the electro-optical detector selectively energizing and de-energizing the electromagnetic lock in response to the detection of the emitted light;

wherein when a push force is applied to the elongated housing, the elongated housing is displaced toward the mounting pad such that the blade of the mounting pad traverses the transmission path obstructing light emitted from the electro-optical source so that the emitted light is not detected by the electro-optical detector, and in response to the non-detection of the emitted light the electro-optical detector de-energizes the electromagnetic lock.

2. The exit sensor bar as defined by claim 1, wherein the mounting pad is comprised of a pair of mounting pads and at least one of the pair of mounting pads includes the blade.

3. The exit sensor bar as defined by claim 1, further comprising:

a relay operatively coupling the electro-optical detector and the electromagnetic lock, the relay being selectively energized and de-energized by the electro-optical detector for energizing and de-energizing the electromagnetic lock.

4. The exit sensor bar as defined by claim 3, wherein the circuit board assembly is comprised of a hinge end circuit board and a latch end circuit board, each of the hinge end and latch end circuit boards includes an electro-optical source and an electro-optical detector, the hinge end and latch end circuit boards operatively coupled together by a wiring harness;

wherein the relay is operatively coupled to the electro-optical detectors of both of the hinge end and latch end circuit boards.

5. The exit sensor bar as defined by claim 1, further comprising:

a pair of end caps coupled to opposing ends of elongated housing and terminating the interior channel.

6. The exit sensor bar as defined by claim 1, wherein the electro-optical source emits an infra-red light.

7. The exit sensor bar as defined by claim 1, wherein the applied push force is greater than zero to about fifteen pounds of pressure applied at any point along the length of the elongated housing.

8. A security system for a door, the door mounted to a door frame that is installed in a building structure, the security system comprising:

a lock mounted to the door, the lock selectively operable between a first condition wherein the door is retained in a fixed position to the door frame and a second condition wherein the door is released for displacement away from the door frame;

a relay coupled to the lock, the relay being selectively energized to provide a first signal to the lock for operation in the first condition and de-energized to provide a second signal to the lock for operation in the second condition; and a sensor bar mounted to the door and operatively coupled to the relay, the sensor bar including:

a pair of mounting pads for affixing the sensor bar to the door, at least one of the pair of mounting pads including a blade extending away from the at least one mounting pad;

an elongated housing having an interior chamber, the interior chamber having a first portion for receiving the mounting pads and a second portion;

a pair of return springs disposed on the mounting pads and within the interior chamber for biasing the elongated housing in a direction away from the mounting pads; and a circuit board assembly disposed within the second portion of the interior chamber in close proximity to the at least one mounting pad, the circuit board assembly including at least an electro-optical source and an electro-optical detector coupled to the relay, the electro-optical detector being disposed a distance away from the electro-optical source to define a transmission path for light emitted from the electro-optical source, the electro-optical detector selectively energizing and de-energizing the relay to provide at least one of the first and second signals in response to the detection of the emitted light;

wherein when a push force is applied to the elongated housing, the bias of the return spring is overcome and the elongated housing is displaced toward the mounting pads such that the blade of the at least one mounting pad traverses the transmission path obstructing light emitted from the electro-optical source so that the emitted light is not detected by the electro-optical detector and in response to the non-detection of the emitted light the electro-optical detector de-energizes the relay.

9. The security system for a door as defined by claim 8, further comprising:

at least one of a key switch and a card reader disposed on a surface of the door opposite to a surface of the door where the exit sensor bar is mounted, the at least one of the key switch and the card reader operatively coupled to the relay for selectively energizing and de-energizing the relay independently of the exit sensor bar.

* * * * *